US005673910A

United States Patent [19]

Wamsley

[11] Patent Number: 5,673,910

[45] Date of Patent: Oct. 7, 1997

[54] APPARATUS AND METHOD FOR USE IN FEEDING SHEET MATERIAL ASSEMBLAGES

[75] Inventor: Richard D. Wamsley, Dayton, Ohio

[73] Assignee: Heidelberg Finishing Systems, Inc., Dayton, Ohio

[21] Appl. No.: 354,545

[22] Filed: Dec. 13, 1994

[51] Int. Cl.[6] ..... B65H 7/02; B65H 5/02

[52] U.S. Cl. ..... 271/259; 271/263; 271/265.04; 271/274; 271/303; 271/184; 271/213; 198/624; 198/644; 270/52.04; 270/52.14

[58] Field of Search ..... 271/1, 213, 262, 271/263, 258.04, 265.04, 267, 273, 274, 292, 303, 304, 314, 259, 272, 184, 226, 251, 252; 198/624, 644; 270/52.04, 52.14, 52.16, 52.29

[56] References Cited

U.S. PATENT DOCUMENTS

| | | | |
|---|---|---|---|
| 1,442,838 | 1/1923 | West | 198/624 |
| 1,580,759 | 8/1926 | Olson | 271/274 X |
| 1,944,712 | 1/1934 | Kast . | |
| 2,192,414 | 3/1940 | Reed | 271/274 |
| 2,233,149 | 2/1941 | Welk | 271/274 X |
| 2,349,659 | 5/1944 | Huck | 271/274 X |
| 2,757,927 | 8/1956 | Bach et al. | 271/274 X |
| 2,935,919 | 5/1960 | O'Neil | 198/624 X |
| 4,188,025 | 2/1980 | Gusfafson et al. | 271/272 X |
| 4,496,339 | 1/1985 | Moll | 271/274 X |
| 4,498,663 | 2/1985 | Wamsley et al. . | |
| 5,098,078 | 3/1992 | Nakanishi | 271/265.04 X |
| 5,328,163 | 7/1994 | Yamada | 271/265.04 X |
| 5,350,170 | 9/1994 | Emigh et al. . | |
| 5,435,540 | 7/1995 | Martin et al. | 271/265.04 X |

FOREIGN PATENT DOCUMENTS

| | | | |
|---|---|---|---|
| 2724387 | 12/1978 | Germany | 271/303 |
| 229745 | 10/1986 | Japan | 271/272 |
| 222950 | 9/1987 | Japan | 271/263 |
| 18243 | 1/1990 | Japan | 271/274 |
| 100935 | 4/1990 | Japan | 271/265.04 |
| 2269371 | 2/1994 | United Kingdom | 271/314 |

*Primary Examiner*—Boris Milef

*Attorney, Agent, or Firm*—Tarolli, Sundheim, Covell, Tummino & Szabo

[57] ABSTRACT

An apparatus for use in feeding sheet material assemblages includes rollers which define a nip through which the sheet material assemblages are moved. Nip adjustment mechanisms are operable to adjust the width and configuration of the nip. When sheet material assemblages which are relatively thick at one end portion are to be fed through the nip, the nip adjustment mechanisms are operated so that the thick portion of the sheet material assemblage is fed through a wide portion of the nip. A gate assembly is provided to direct the sheet material assemblages toward either a reject tray or a trimmer mechanism. The size of the nip can be changed without varying the setting of the gate assembly. Similarly, the setting of the gate assembly can be changed without varying the size of the nip. When the size of the nip is varied, the reject tray is moved with rollers which define one side of the nip.

31 Claims, 7 Drawing Sheets

APPARATUS AND METHOD FOR USE IN FEEDING SHEET MATERIAL ASSEMBLAGES

BACKGROUND OF THE INVENTION

The present invention relates to a method and apparatus for use in sequentially feeding sheet material assemblages of different sizes.

A known apparatus for feeding sheet material assemblages is disclosed in U.S. Pat. No. 4,498,663. This known apparatus includes a pair of rollers which define a nip through which the sheet material assemblages are fed. A gate assembly can be set to direct the sheet material assemblages toward either a reject tray or toward a trimmer assembly. When the setting of the gate assembly is changed, a cam changes the size of the nip. Similarly, when the size of the nip is changed, the setting of the gate assembly is changed.

SUMMARY OF THE INVENTION

The present invention provides a new and improved method and apparatus for feeding sheet material assemblages. The apparatus includes rollers which define a nip through which the sheet material assemblages are fed. A nip adjustment mechanism is provided to adjust the width of the nip. The nip may have either a uniform or a nonuniform width. When the nip has a nonuniform width, a relatively thick end portion of a sheet material assemblage is fed through a relatively wide portion of the nip.

A gate assembly is operable from a first condition to a second condition to change the direction in which sheet material assemblages are directed away from the nip. The gate assembly can be actuated between the first and second conditions without changing the size of the nip. Similarly, the size of the nip can be varied without changing the setting of the gate assembly.

BRIEF DESCRIPTION OF THE DRAWINGS

The foregoing and other objects and features of the present invention will become more apparent upon a consideration of the following description taken in connection with the accompanying drawings wherein.

DESCRIPTION OF ONE SPECIFIC PREFERRED EMBODIMENT OF THE INVENTION

General Description

Figures 1, 3:
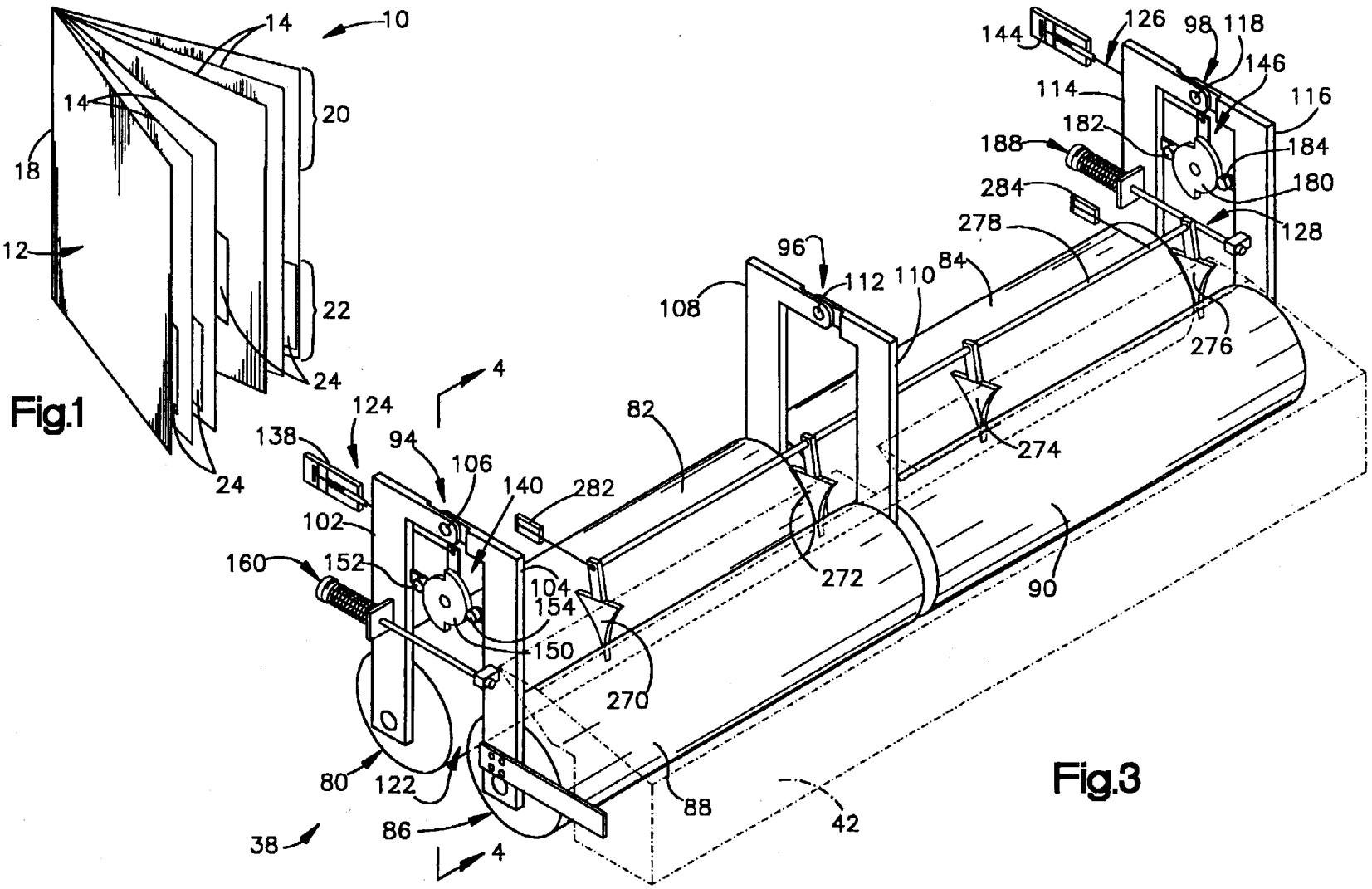
FIG. 1 is a schematic illustration of a sheet material assemblage having a folded edge portion which extends between thick and thin end portions of the sheet material assemblage.
FIG. 3 is a schematic illustration of a delivery assembly which is constructed and operated in accordance with the present invention and which is used in the sheet material handling apparatus of FIG. 2.

A sheet material assemblage 10 is illustrated in FIG. 1. The sheet material assemblage 10 includes a cover 12 which encloses a plurality of pages or signatures 14. The sheet material assemblage 10 may have any desired number of pages and may be a pamphlet, booklet, magazine or similar article.

The sheet material assemblage 10 has a folded edge portion or spine 18 which extends between a head end portion 20 and a foot end portion 22. A plurality of inserts 24 are provided in the foot end portion 22. The inserts 24 have a relatively short height and do not extend into the head end portion 20. Therefore, the foot end portion 22 is thicker than the head end portion 20.

The number of inserts 24 provided in the sheet material assemblage 10 will vary depending upon the characteristics of the intended reader of the sheet material assemblage. In addition, the number of pages or signatures 14 will vary depending upon the characteristics of the intended reader. Therefore, the thickness of the head end portion 20 and/or foot end portion 22 of the sheet material assemblage 10 will vary depending upon the characteristics of the intended reader. For some intended readers, the sheet material assemblage 10 may be formed without any inserts 24 and have a uniform thickness.

A sheet material handling apparatus 30 (FIG. 2) is operable to sequentially form, stitch and trim sheet material assemblages 10. The sheet material assemblages 10 formed with the sheet material handling apparatus 30 will have different constructions. Thus, one sheet material assemblage 10 (FIG. 1) may not have any inserts 24 so that the head end portion 20 of the sheet material assemblage has the same thickness as the foot end portion 22 of the sheet material assemblage.

A second sheet material assemblage 10 may have a greater number of pages 14, so that both the head and foot end portions 20 and 22 of this sheet material assemblage are thicker than the foot and head end portions of the preceding sheet material assemblage. In addition, the second sheet material assemblage 10 may have a plurality of inserts 24 so that the foot end portion 22 of the second sheet material assemblage is thicker than the head end portion 20 of the sheet material assemblage. A third sheet material assemblage 10 may have still more pages 14 and/or more inserts 24. The sheet material assemblages 10 may be formed in any desired sequence by the apparatus 30.

The general construction of the sheet material handling apparatus 30 is known and includes a collator 32 (FIG. 2) which is operable to sequentially feed pages 14 and covers 12 to receiving locations on a conveyor 34. In addition, the collator 32 is operable to feed inserts 24 to the receiving locations on the conveyor 34. The number of pages 14 and the number of inserts 24 fed by the collator 32 to receiving locations on the conveyor 34 will vary depending upon the characteristics of the intended reader of a sheet material assemblage.

The conveyor 34 conducts each of the sheet material assemblages 10 in turn through a stitcher assembly 36 where the sheet material assemblages are sequentially stapled along the folded edge portion 18. A delivery assembly 38, constructed and operated in accordance with the present invention, directs sheet material assemblages 10 containing the desired number of pages 14 and inserts 24 to a trimmer assembly 40. The delivery assembly 38 directs defective or numerically imperfect sheet material assemblages 10 containing less than the desired number of pages 14 and/or inserts 24 to a reject tray or holder 42.

Figure 2:
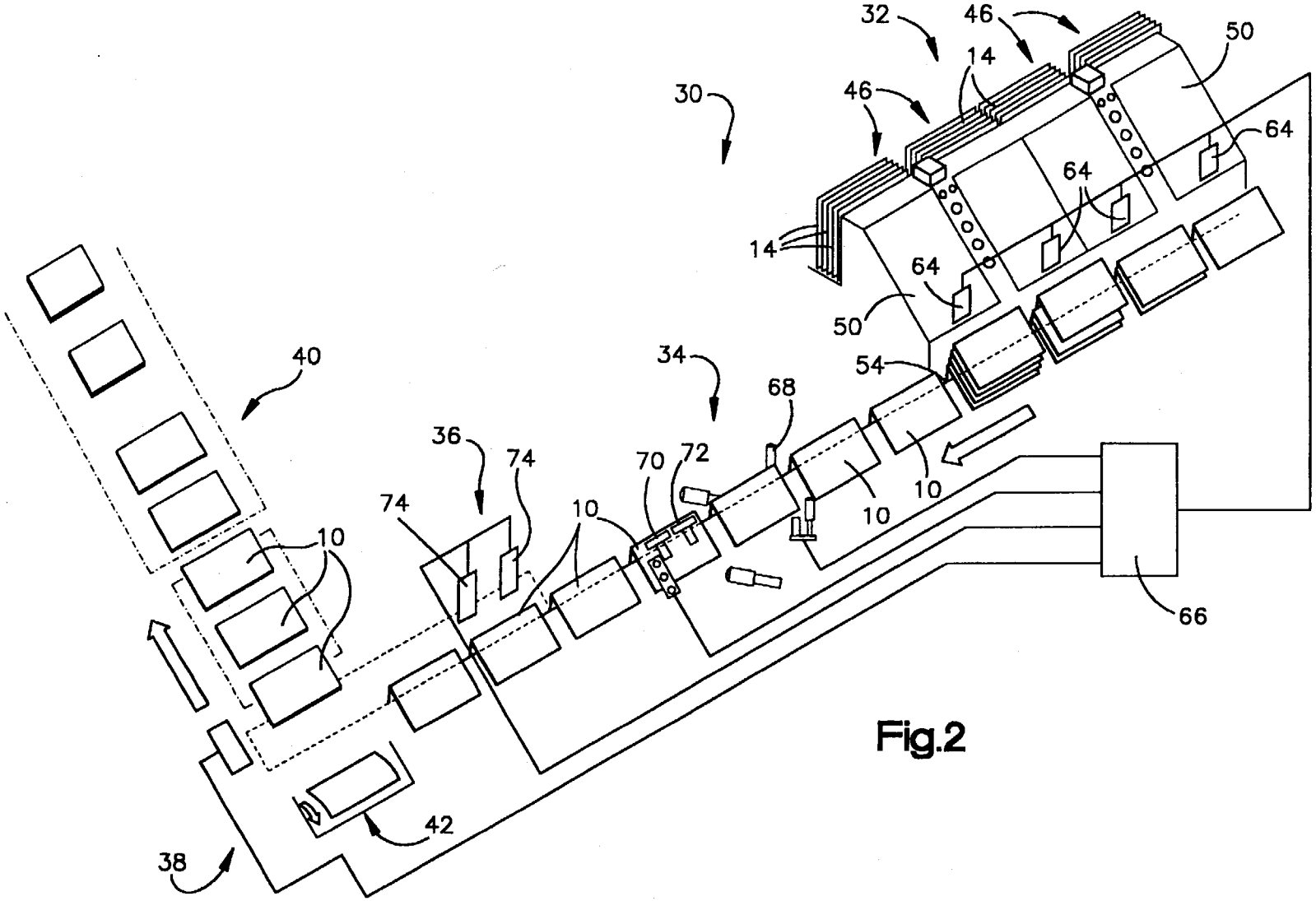
FIG. 2 is a schematic illustration of a sheet material handling apparatus.

The collator 32 (FIG. 2) includes a plurality of vertical hoppers 46 which hold either signatures 14 or inserts 24. The signatures 14 and inserts 24 are fed by feeders 50 to the conveyor 34. The feeders 50 are of a known construction and include a rotor drum which engages a signature 14 or an insert 24 in one of the hoppers 46 and transfers the signature or insert to a pair of opener drums which open the signature or insert and drop it onto the saddle type conveyor 34. Although only a few feeders 50 are shown in FIG. 2 to sequentially feed signatures 14 and inserts 24 to the conveyor 34, the collator 32 has a substantially greater number of feeders.

The conveyor 34 includes an endless chain 54 having pusher fingers which engage the trailing edge portion, that is the foot end portion 22, of each of the sheet material assemblages 10 in turn. As a pusher finger in the conveyor 34 moves past a first one of the feeders 50, an initial page 14 is dropped onto a receiving location on the chain 54. As this receiving location moves past each of the signature feeders 50 in turn, a signature 14 or an insert 24 is deposited at the receiving location. At the last feeder 50 in the collator 32, the cover 12 is deposited at the receiving location to complete the formation of the sheet material assemblage 10.

During operation of the collator 32, sheet material assemblages 10 containing different numbers of pages 14 and/or inserts 24 are sequentially formed by operating a greater or lesser number of feeders 50. The feeders 50 feed different numbers of signatures 14 to different receiving locations on the conveyor 34, depending upon the characteristics of the intended reader of the sheet material assemblage being formed at each of the receiving locations on the conveyor. In addition, the collator 32 feeds a greater or lesser number of inserts 24 to a receiving location on the conveyor 34, depending upon the characteristics of the intended reader of the sheet material assemblage being formed at the receiving location on the conveyer. Since the number of signatures or pages 14 in the sheet material assemblages 10 will vary, the thickness of the head end portions 20 (FIG. 1) of the sheet material assemblages vary. The thickness of the foot end portions 22 of the sheet material assemblages will also vary due to the presence of a greater or lesser number of inserts 24 and/or the presence of a greater or lesser number of pages 14.

During operation of the collator 32, an occasional misfeed may occur in one of the feeder units 50 with a resulting failure to feed a signature and/or insert 24 onto the chain 54. This results in the formation of a numerically imperfect or defective sheet material assemblage 10 containing less than the desired number of signatures 14 and/or inserts 24. A detector unit 64 (FIG. 2) is associated with each of the signature feeders 50 to detect the occurrence of a misfeed.

Upon the occurrence of a misfeed, a control assembly 66 renders feeder units 50 downstream of the location where the misfeed occurred ineffective to feed signatures 14 or inserts 24. Thus, when a signature misfeed occurs, the detector 64 at the location where the misfeed occurred signals the control assembly 66. The control assembly 66 then renders the downstream feeders 50 ineffective to feed a signature 14 or insert 24 whenever the location on the conveyor chain at which a misfeed occurs passes through a downstream feeder. This results in the conveyor 34 transporting both thick sheet material assemblages 10 containing a desired number of signatures 14 and inserts 24 and thin sheet material assemblages containing only the signatures which were fed to the sheet material assemblage before the misfeed occurred.

After the sheet material assemblages 10 have moved out of the collator 32, they move through a long/skew signature group detector 68 which detects when a group of signatures is defective due to misorientation of one or more signatures. A head end portion caliper 70 and a foot end portion of caliper 72 are used to detect the thickness of both the head end portion 20 and foot end portion 22 of each of the sheet material assemblages 10 in turn. Thus, the caliper 70 detects the thickness of the leading head end portion 20 of a sheet material assemblage 10 and the caliper 72 detects the thickness of the trailing foot end portion 22 of a sheet material assemblage 10. Rather than using a pair of separate calipers 70 and 72, a single caliper assembly could be used to detect the thickness of both the head end portion 20 and foot end portion 22 of a sheet material assemblage if desired. If a sheet material assemblage 10 is defective due to either misorientation of a signature or having more or less than the desired number of signatures and/or inserts, this fact is transmitted to the control assembly 66 by either the long skew signature detector 68, the head end portion caliper unit 70, or the foot end portion caliper unit 72.

When the sheet material assemblages 10 are moved into the stitcher assembly 36, the correctly formed groups of signatures are stitched in the stitcher assembly by staplers 74. The control assembly 66 renders the staplers 74 ineffective to stitch defective sheet material assemblages 10. The conveyor 34 transports the sheet material assemblages 10 from the stitcher assembly 36 to a location beneath the delivery assembly 38. A tucker blade 76 (FIG. 4) moves each sheet material assemblage 10 in turn into the delivery assembly 38.

The delivery assembly 38 (FIG. 2) sorts the correctly formed sheet material assemblages 10 from the defective sheet material assemblages. The correctly formed sheet material assemblages 10 are directed by the delivery assembly 38 toward the trimmer 40. The defective groups of signatures are directed to the reject tray 42. The operation of the delivery assembly 38 is controlled by the control assembly 66.

The control assembly 66 is operable to adjust the delivery assembly 38 to sequentially handle sheet material assemblages 10 with head and/or foot end portions 20 and 22 with different thicknesses. Thus, the head and foot end portion calipers 70 and 72 measure the thickness of the head and foot end portions 20 and 22 of each of the sheet material assemblages in turn. The thickness measurements made by the head and foot end portion calipers 70 and 72 are transmitted to the control assembly 66. The control assembly 66 actuates the delivery assembly 38 in accordance with the thickness measurements made by the head and foot end portion calipers 70 and 72 immediately before each sheet material assemblage 10 moves through the delivery assembly 38.

With the exception of the delivery assembly 38, the general construction and mode of operation of the sheet material handling apparatus 30 is well known. Thus, the sheet material handling apparatus 30 may have the same general construction as disclosed in the aforementioned U.S. Pat. No. 4,498,663. Sheet material handling apparatus having this general construction and mode of operation is commercially available from AM Graphics having a place of business at 4900 Webster Street, Dayton, Ohio 45414.

Delivery Assembly

In accordance with one of the features of the present invention, the delivery assembly 38 (FIG. 3) can be used to sequentially feed sheet material assemblages 10 having different uniform thicknesses or different nonuniform thicknesses. Thus, the delivery assembly 38 can be used to feed sheet material assemblages 10 which do not contain inserts 24. The sheet material assemblages 10 may have different numbers of pages 14. The delivery assembly 38 can also be used to feed sheet material assemblages 10 containing different numbers of inserts 24 and/or different numbers of pages 14.

The delivery assembly 38 includes a first set 80 of rollers 82 and 84 (FIG. 3). The delivery assembly 38 includes a second set 86 of rollers 88 and 90. The rollers 82, 84, 88 and 90 have a cylindrical configuration and are of the same diameter and length. The two sets 80 and 86 of rollers are supported on support structures 94, 96 and 98.

The left (as viewed in FIG. 3) support structure 94 includes a pair of arms 102 and 104 which are interconnected at a pivot connection 106. Similarly, the central support structure 96 includes a pair of arms 108 and 110 which are interconnected at a pivot connection 112. The right support structure 98 includes a pair of arms 114 and 116 which are interconnected at a pivot connection 118.

The left (as viewed in FIG. 3) ends of the rollers 82 and 88 are rotatably connected with the arms 102 and 104 of the left support structure 94. The right ends of the rollers 82 and 88 are rotatably connected with the arms 108 and 110 if the central support structure 96. The left ends of the rollers 84 and 90 are also connected with the arms 108 and 110 of the central support structure 96. The right ends of the rollers 84 and 90 are rotatably connected with the arms 114 and 116 of the right support structure 98. The arms 102, 104, 108, 110, 114 and 116 are supported by a suitable frame (not shown in FIG. 3). Instead of using three sets of arms to support the two sets of rollers 80 and 86, four sets of arms could be utilized with one set of arms being connected with an end of a set of rollers.

A linear nip 122 is formed between the two sets 80 and 86 of rollers. Nip adjustment mechanisms 124 and 126 are provided to adjust the width and configuration of the nip 122. Only two nip adjustment mechanisms 124 and 126 are used in the embodiment of the invention illustrated schematically in FIG. 3. However, if four sets of arms were provided to support the two sets 80 and 86 of rollers, four nip adjustment mechanisms would be provided, that is, one nip adjustment mechanism for each of the four sets of arms. In the illustrated embodiment of the invention, a nip adjustment mechanism is not provided in association with the arms 108 and 110 which are connected with the center portion of the two sets 80 and 86 of rollers. This is because the rollers 82 and 84 are interconnected and the rollers 88 and 90 are interconnected so that only two nip adjustment mechanisms 124 and 126 are required.

Figure 4:
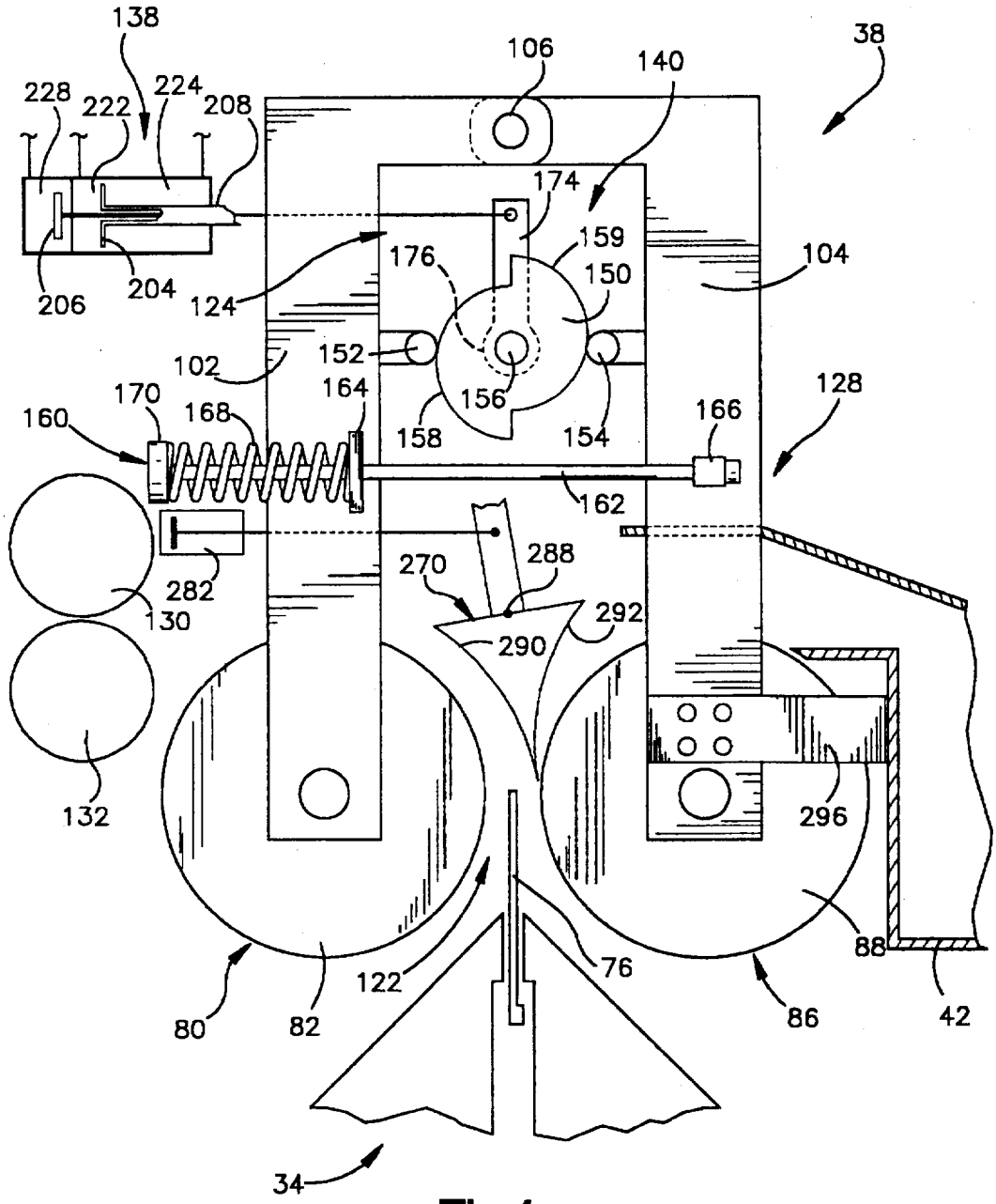
FIG. 4 is an end view, taken on an enlarged scale along the line 4—4 of FIG. 3, further illustrating the construction of the delivery assembly.

The delivery assembly 38 is disposed above the conveyor 34 (FIG. 4). The longitudinal central axis of the nip 122 extends parallel to the longitudinal central axis of the conveyor 34. When a sheet material assemblage 10 is to be moved into the nip 122 by the tucker blade 76, a longitudinal central axis of the spine portion 18 of the sheet material assemblage is in the same vertical plane as a longitudinal central axis of the nip. At this time, the head end portion 20 of the sheet material assemblage 10 is vertically aligned with the portion of the nip 122 disposed between the rollers 82 and 88 (FIG. 3). The foot end portion 22 of the sheet material assemblage 10 is vertically aligned with the portion of the nip 122 disposed between the rollers 84 and 90.

A gate or director assembly 128 is provided to direct sheet material assemblages 10 exiting from the nip 122 toward either the reject tray or holder 42 or toward a pair of feed rollers 130 and 132 (FIG. 4). Thus, the gate assembly 128 is operable to direct correctly formed sheet material assemblages 10 toward the left (as viewed in FIG. 4) and the feed rollers 130 and 132. These sheet material assemblages are conveyed to the trimmer assembly 40 (FIG. 2).

Defective or incorrectly formed sheet material assemblages 10 are directed toward the right (as viewed in FIG. 4) by the gate assembly 128. The defective sheet material assemblages 10 accumulate in the reject tray or holder 42. The control assembly 66 (FIG. 2) controls operation of the nip adjustment mechanisms 124 and 126 (FIG. 3) and the gate assembly 128 (FIGS. 3 and 4) in response to measurements made by the head and foot end portion calipers 70 and 72 (FIG. 2).

Nip Adjustment Mechanisms

In accordance with a feature of the invention, the nip adjustment mechanisms 124 and 126 are operable to vary the size and configuration of the nip 122 between the two sets 80 and 86 (FIG. 3) of rollers to accommodate each of the sheet material assemblages 10 in turn. The nip adjustment mechanisms 124 and 126 have the same construction and mode of operation. The nip adjustment mechanism 124 (FIG. 4) includes a nip adjustment motor 138 which is connected with an actuator assembly 140. The actuator assembly 140 is operable to vary the distance between the arms 102 and 104 to thereby vary the width of the left (as viewed in FIG. 5) portion 194 of the nip 122 in accordance with measurements made by the head end portion caliper 70 (FIG. 2).

Similarly, the nip adjustment mechanism 126 (FIG. 3) includes a nip adjustment motor 144 which is connected with an actuator assembly 146. Operation of the actuator assembly 146 is operable to move the arms 114 and 116 relative to each other to vary the width of the right (as viewed in FIG. 5) portion 196 of the nip 122. The actuator assembly 146 is operable to vary the width of the right portion 196 of the nip 122 in accordance with measurements made by the foot end portion caliper 72 (FIG. 2).

The actuator assembly 140 (FIG. 4) includes a cam 150 which is disposed midway between the arms 102 and 104. A cam follower 152 is connected with the arm 102 and engages the cam 150. Similarly, a cam follower 154 is connected with the arm 104 and engages a portion of the cam 150 opposite from the portion engaged bythe cam follower 152. The cam 150 is fixedly mounted on a rotatable shaft 156. The cam 150 has opposite ramp portions 158 and 159 which have the same configuration.

A biasing assembly 160 is connected with the arms 102 and 104. The biasing assembly 160 urges the arms 102 and 104 toward each other to press the cam followers 152 and 154 against the cam 150. The biasing assembly 160 includes a rod 162 which extends through and is slidable relative to mounting sections 164 and 166 connected with the arms 102 and 104. A spring 168 is disposed between the mounting section 164 and a knob 170 on the outer end of the rod 162. The knob 170 has internal threads which engage external threads on the outer end portion of the rod 162.

The force applied bythe spring 168 against the mounting section 164 urges the arm 102 toward the right (as viewed in FIG. 4). The force applied by the spring 168 against the knob 170 is transmitted through the rod 162 to the mounting section 166. This force urges the arm 104 toward the left (as viewed in FIG. 4). The knob 170 is rotatable relative to the rod 162 to vary the force applied against the knob and mounting section 164 by the spring 168.

The nip adjustment motor 138 is connected with an arm 174 which is releasably connected with the rotatable shaft 156 on which the cam 150 is fixedly mounted. Thus, a releasable connection, indicated schematically at 176 in FIG. 4, is provided between the arm 174 and the shaft 156. By releasing the connection 176, the shaft 156 and cam 150 are rotatable relative to the arm 174. This enables the initial position of the cam 150 to be adjusted. By adjusting the initial position of the cam 150 relative to the arm 174, the initial size of the left (as viewed in FIG. 5) portion 194 of the nip 122 can be adjusted.

The actuator assembly 146 (FIG. 3) connected with the arms 114 and 116 at the right ends of the sets 80 and 86 of rollers has the same construction as the actuator assembly 140. Thus, the actuator assembly 146 includes a cam 180 which is disposed between the arms 114 and 116 and is engaged by cam followers 182 and 184. A biasing assembly 188 urges the cam followers 182 and 184 into engagement with the cam 180.

The arms 108 and 110 on the central support structure 96 (FIG. 3) are freely movable relative to each other. A support shaft for the roller 82 is connected with the arm 102 in the left (as viewed in FIG. 3) support structure 94 and with the arm 108 in the central support structure 96. Similarly, a support shaft for the roller 84 is connected with the arm 108 in the central support structure 96 and with the arm 114 in the right support structure 98. If desired, the rollers 82 and 84 could each be formed by a plurality of separate rollers connected with the support structures 94, 96 and 98.

A support shaft for the roller 88 is connected with the arm 104 in the support structure 94 and the arm 110 in the central support structure 96. A support shaft for the roller 90 is connected with the arm 110 in the central support structure 96 and the arm 116 in the right support structure 98. If desired, the rollers 88 and 90 could each be formed by a plurality of separate rollers connected with the support structures 94, 96, and 98. A suitable drive assembly (not shown in FIG. 3) is provided to rotate the rollers 82, 84, 88 and 90 to feed sheet material assemblages 10 through the nip 122.

Since there are two nip adjustment mechanisms 124 and 126, they can be utilized to provide the nip 122 with a uniform width throughout its length or with a width which tapers from a relatively narrow portion at one end of the nip to a relatively wide portion at the opposite end of the nip. When the cams 150 and 180 are both placed in their central positions, as illustrated schematically in FIG. 3, the nip 122 has a uniform width throughout its length. This is because the arms 102 and 104 and the cam followers 152 and 154 are spaced the same distance apart as are the arms 114 and 116 and the cam followers 182 and 184.

The width of the nip 122 can be either increased or decreased while maintaining a uniform width along the length of the nip by merely rotating both cams 150 and 180 the same distance in the same direction. Thus, if the width of the nip 122 is to be increased throughout its length, the cam 150 is rotated in a clockwise direction as viewed in FIG. 3. At the same time, the cam 180 is rotated in a clockwise direction as viewed in FIG. 3, through the same distance which the cam 150 is rotated. This moves the cam followers 152 and 154 and the cam followers 182 and 184 through the same distance to thereby increase the width of both ends of the nip 122 by the same amount. To decrease the width of the nip 122, the cams 150 and 180 are rotated in a counterclockwise direction.

Figure 5:
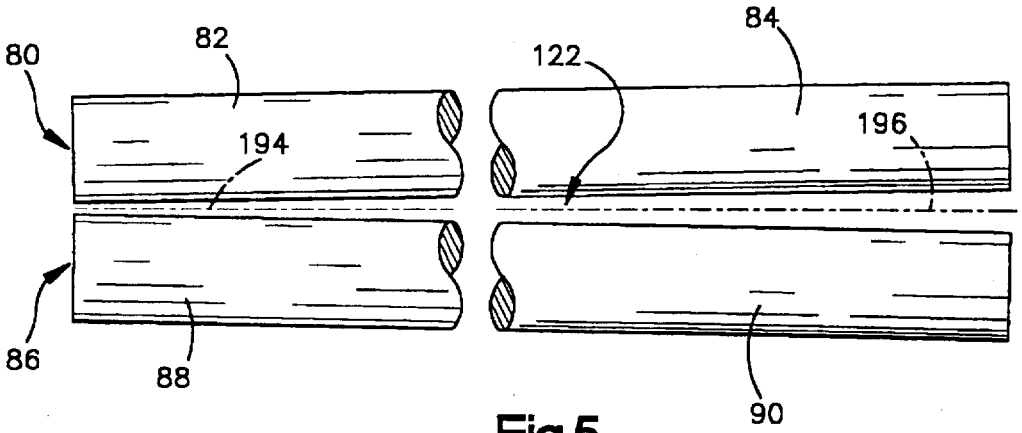
FIG. 5 is a highly schematicized plan view illustrating the manner in which a nip formed between rollers of the delivery assembly of FIG. 4 tapers from a wide portion to a narrow portion.

When sheet material assemblages 10 containing inserts 24 (FIG. 1) are to be fed by the delivery assembly 38 (FIG. 3), the sheet material assemblages have a nonuniform thickness. These sheet material assemblages are advantageously fed through a nip 122 having a nonuniform width. If the nip 122 is to have a nonuniform width, as shown in FIG. 5, the cam 150 is rotated in a counterclockwise direction from the central position shown in FIG. 3 to decrease the width of the left (as viewed in FIG. 5) portion 194 of the nip 122. At the same time, the cam 180 is rotated in a clockwise direction from the central position shown in FIG. 3 to increase the width of a right (as viewed in FIG. 5) portion 196 of the nip 122.

The cams 150 and 180 can both be rotated to adjust their initial positions while the nip adjustment motors 138 and 144 are inactive. Thus, the connection 176 (FIG. 4) which secures the cam 150 and shaft 156 with the arm 174 can be released. This enables the cam 150 to be rotated to either increase or decrease the width of the left portion 194 of the nip 122. Once the cam 150 has been rotated so that the left portion 194 (FIG. 5) of the nip 122 has the desired width, the connection 176 (FIG. 4) is engaged to again connect the arm 174 with the shaft 156 and cam 150. The position of the cam 180 relative to the cam followers 182 and 184 (FIG. 3) can be adjusted in the same manner as the cam 150. Either one or both of the cams 150 and 180 can be adjusted so that the left portion 194 and right portion 196 of the nip 122 have the desired initial widths.

Nip Adjustment Motor

Figure 6:
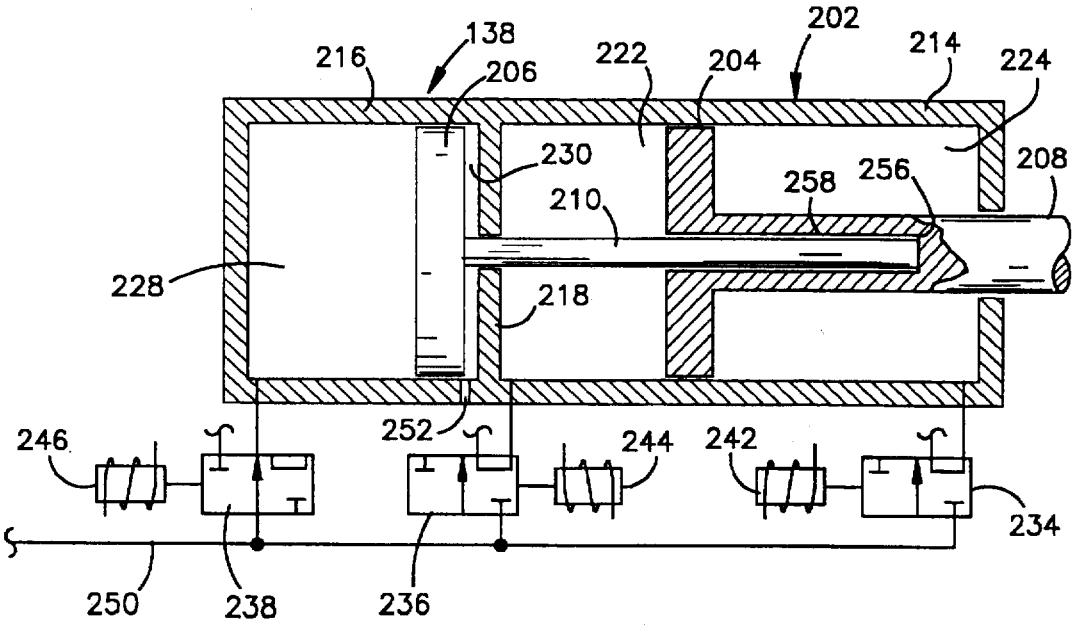
FIG. 6 is a schematic illustration, of a nip adjustment motor used in the delivery assembly of FIG. 4 to vary the width and configuration of the nip.

The nip adjustment motor 138 is illustrated schematically in FIG. 6. The nip adjustment motor 138 is operable, by the control assembly 66 (FIG. 2) from the illustrated initial condition shown in FIG. 6 to rotate the cam 150 in either a clockwise or a counterclockwise direction. When the head end portion caliper 70 (FIG. 2) detects that a sheet material assemblage 10 has a relatively thick head end portion 20, the nip adjustment motor 138 is operated to increase the width of the left portion 194 of the nip 122 immediately before the measured sheet material assemblage 10 moves into the nip.

Similarly, if the head end portion caliper 70 detects that a sheet material assemblage 10 has a relatively thin head end portion 20, the nip adjustment motor 138 is operated to decrease the width of the left portion 194 of the nip 122 immediately before the measured sheet material assemblage moves into the nip.

The nip adjustment motor 138 (FIG. 6) includes a main cylinder 202 in which a pair of cylindrical pistons 204 and 206 are disposed. The pistons 204 and 206 have axially extending cylindrical piston rods 208 and 210. The piston rod 210 is telescopically received in the piston rod 208.

The main cylinder 202 is divided into a first section 214 and a second section 216 by a circular cylinder wall 218. The first section 214 has an axial extent which is twice as great as the axial extent of the second section 216.

When the motor 138 is in the initial condition of FIG. 6, the piston 204 divides the first section 214 into a pair of cylindrical variable volume chambers 222 and 224. Similarly, the piston 206 divides the section 216 into a pair of cylindrical variable volume chambers 228 and 230. The piston rod 208 is connected with the arm 174 (FIG. 4) and the cam 150. If desired, the motor 138 could have an initial condition which is different than the initial condition shown in FIG. 6.

One specific embodiment of the nip adjustment motor 138 is commercially available from Mozier Fluid Power having a place of business at 2220 West Dorothy Lane, Dalton, Ohio 45439, under Order No. S3808. Of course, a nip adjustment motor having a construction which is different from the specific construction which has been illustrated schematically in FIG. 6 and which has been described herein could be used if desired.

Upon movement of the piston rod 208, the arm 174 is effective to rotate the cam 150 from the central or initial position shown in FIG. 4. Thus, upon movement of the piston rod 208 toward the right (as viewed in FIGS. 4 and 6), the arm 174 and cam 150 are rotated in a clockwise direction (as viewed in FIG. 4). This results in the cam 150 moving the arms 102 and 104 away from each other to increase the width of the left portion 194 (FIG. 5) of the nip 122. Similarly, upon movement of the piston rod 208 toward the left (as viewed in FIGS. 4 and 6), the arm 174 and cam 150 are rotated in a counterclockwise direction to decrease the width of the left portion 194 (FIG. 5) of the nip 122.

Motor control valves 234, 236 and 238 (FIG. 6) are operable by solenoids 242, 244 and 246 to effect operation of the nip adjustment motor 138. The solenoids 242, 244 and 246 are connected with the control assembly 66 (FIG. 2). When the caliper 70 detects that the head end portion 20 (FIG. 1) of a sheet material assemblage 10 is relatively thin, the control assembly 66 effects operation of the motor 138 to decrease the thickness of the left portion 194 of the nip 122 immediately before the sheet material assemblage moves into the nip. When the caliper 70 detects that the head end portion 20 of a sheet material assemblage 10 is relatively thick, the control assembly 66 effects operation of the motor 138 to increase the thickness of the left portion 194 of the nip 122 immediately before the sheet material assemblage moves into the nip.

When the nip adjustment motor 138 is in a central or initial condition, illustrated in FIG. 6, the solenoid 246 is energized by the control assembly 66. This actuates the motor control valve 238 to enable fluid (air) under pressure to be conducted from a conduit 250 to the motor cylinder chamber 228. The fluid pressure in the motor cylinder chamber 228 urges the piston 206 to the right (as viewed in FIG. 6) end of its stroke. The motor cylinder chamber 230 is vented to atmosphere through an opening 252.

The piston rod 210 on the piston 206 engages a circular end surface 256 of a cylindrical recess 258 in the piston rod 208. This results in the piston 204 being in the central position illustrated in FIG. 6 when the piston 206 is at the right end of stroke position shown in FIG. 6. If desired, a pneumatically actuated clamp may be provided to grip the piston rod 208 and hold it against movement until such time as one of the motor control valves 234, 236 or 238 is actuated.

Assuming that the cam 150 is to be rotated in a clockwise direction (as viewed in FIG. 4) to increase the width of the left portion 194 (FIG. 5) of the nip 122, the nip adjustment motor 138 is operated to move the piston rod 208 toward the right (as viewed in FIG. 6). To accomplish this, the solenoid 244 actuates the motor control valve 236 to direct fluid (air) under pressure from the conduit 250 to the motor cylinder chamber 222. This results in the piston 204 moving toward the right. As this occurs, air is forced from the cylinder chamber 224 to atmosphere through the motor control valve 234.

As the piston rod 208 moves toward the right (as viewed in FIGS. 4 and 6), the arm 174 (FIG. 4) and cam 150 are rotated in a clockwise direction. As this occurs, the cam moves the cam followers 152 and 154 away from each other to pivot the support arms 102 and 104 and increase the size of the left portion 194 (FIG. 5) of the nip 122. As this occurs, the piston 206 (FIG. 6) remains stationary in the cylinder 202.

As the nip adjustment motor 138 is operated to rotate the cam 150 and increase the size of the left portion 194 (FIG. 5) of the nip 122, the nip adjustment motor 144 (FIG. 3) may be inactive and the cam 180 may remain stationary. This results in the size of the left portion 194 of the nip 122 approaching the size of the right portion 196 (FIG. 5) of the nip. However, the initial setting of the cams 150 and 180 is such that the nip 122 still tapers from the right (as viewed in FIG. 6) to the left.

If desired, the initial setting of the cams 150 and 180 can be such that operation of the nip adjustment motor 138 to increase the width of the left portion 194 of the nip 122 while the nip adjustment motor 144 (FIG. 3) remains inactive results in the left portion 194 of the nip 122 having the same width as the right portion 196 of the nip. With this initial setting of the cams 150 and 180, the nip adjustment motor 144 can be operated to decrease the width of the right portion 196 of the nip to a width which is smaller than the width of the left portion 194 of the nip. This results in the configuration of the nip 122 being changeable from the right to left taper shown in FIG. 5 to a left to right taper.

It is believed that it will usually, but not always, be preferred to have the initial settings of the cams 150 and 180 (FIG. 3) such that both nip adjustment motors 138 and 144 have to be operated from their initial conditions to change the tapered configuration of the nip 122 to a uniform width. Thus, the nip adjustment motor 138 is operated to increase the width of the left portion 194 (FIG. 5) of the nip 122. The nip adjustment motor 144 is also operated to decrease the width of the right portion 196 of the nip. This maximizes the extent to which the nip 122 can taper from right to left (as viewed in FIG. 5) and the number of inserts 24 which can be accommodated by adjustment of the nip.

After having operated the nip adjustment motor 138 from the initial condition of FIG. 6 to a rightward actuated condition by moving the piston 204 toward the right, the nip adjustment motor 138 can be operated to move the piston 204 back to the initial position and decrease the size of the left portion 194 of the nip. If this is to be done, the solenoid 242 is actuated bythe control assembly 66. This operates the motor control valve 234 and directs high pressure fluid from the supply conduit 250 to the right motor cylinder chamber 224. At this time, the motor cylinder chamber 222 is vented to atmosphere through the motor control valve 236. Therefore, the piston 204 moves back to the initial or central position shown in FIG. 6.

If the cam 150 is to be rotated in a counterclockwise direction (as viewed in FIG. 4) to decrease the size of the left portion 194 of the nip 122, the solenoid 246 (FIG. 6) is actuated by the control assembly 66. This operates the motor control valve 238 to vent the motor cylinder chamber 228 to atmosphere. Simultaneously therewith, the solenoid 242 is actuated by the control assembly 66. This operates the motor control valve 234 to direct high pressure fluid (air) to the motor cylinder chamber 224. At this time, the motor cylinder chamber 222 is vented to atmosphere through the motor control valve 236. This results in the piston 204 moving toward the left.

As the piston 204 moves toward the left, force is transmitted through the piston rods 208 and 210 to the piston 206. This force moves the piston 206 toward the left. The leftward movement of the piston rods 208 and 210 rotates the arm 174 (FIG. 4) and cam 150 in a counterclockwise direction.

Counterclockwise rotation of the cam 150 results in the cam followers 152 and 154 moving inward toward each other. As this occurs, the support arms 102 and 104 move inward toward each other about the pivot connection 106. This results in the width of the left portion 194 of the nip 122 being decreased.

When the nip adjustment motor 138 is to be operated back to the initial condition shown in FIG. 6, the solenoid 246 is actuated by the control assembly 66. The motor control valve 238 directs high pressure fluid to the motor cylinder chamber 228. At this time, the motor cylinder chambers 222 and 224 are vented to atmosphere through the motor control valves 236 and 234.

Although only the nip adjustment motor 138 has been shown in FIG. 6, it should be understood that the nip adjustment motor 144 (FIG. 3) has the same construction and mode of operation as the nip adjustment motor 138. By operating the nip adjustment motors 138 and 144, the size and configuration of the nip 122 can be varied through a substantial range. The nip adjustment motors 138 and 144 may be operated simultaneously to vary the width of both end portions 194 and 196 of the nip 122. Only one of the nip adjustment motors 138 or 144 is operated to vary the width of one of the end portions 194 or 196 of the nip 122.

The substantial range of adjustment for the nip 122 allows the nip to be adjusted to have a uniform width to accommodate sheet material assemblages 10 which do not have any inserts 24. By operating the nip adjustment motors 138 and 144, the nip 122 can be adjusted to have a relatively narrow left portion 194 (FIG. 5) and to taper from the right portion 196 to the left portion to accommodate sheet material assemblages having relatively few pages 14 and relatively few inserts 24. Similarly, the nip 122 can be adjusted to have a relatively wide width and to taper from the right portion 196 to the left portion 194 to accommodate sheet material assemblages 10 having a relatively large number of pages 14 and a relatively small number of inserts 24. The width of the right portion 196 may be increased relative to the width of the left portion 194 to increase the extent of taper of the nip 122 to thereby accommodate sheet material assemblages 10 having a relatively large number of pages 14 and a relatively large number of inserts 24.

Gate Assembly

The gate assembly 128 is operable between a first condition, shown in FIG. 4, in which it is effective to direct sheet material assemblages 10 exiting from the nip 122 toward feed rollers 130 and 132. The gate assembly 128 is operable to a second condition in which it is effective to direct sheet material assemblages toward the reject tray or holder 42. The gate assembly 128 can be operated between either the first condition or the second condition without changing the width or configuration of the nip 122. Similarly, the nip 122 can be changed without varying the condition of the gate assembly 128.

The gate assembly 128 includes a plurality of gate members or directors 270, 272, 274, and 276 (FIG. 3). The gate members or directors are interconnected by an actuator bar 278. Piston and cylinder type actuator motors 282 and 284 are connected with opposite ends of the bar 278 and are operable to pivot the gate members 270–276 to direct sheet material assemblages toward either the feed rollers 130 and 132 or the reject tray 42. Operation of the actuator motors 282 and 284 is controlled by the control assembly 66 (FIG. 2).

The gate member 270 (FIG. 4) is pivotally supported at 288. When the gate member 270 is in the position illustrated in FIG. 4, an arcuate curving surface 290 on the gate member is effective to direct sheet material assemblages exiting from the nip 122 along an arcuately curving path toward the feed rollers 130 and 132. Of course, other rollers and/or guides are provided to direct the sheet material assemblage to the nip between the feed rollers 130 and 132 in a known manner.

Upon operation of the actuator motors 282 and 284 (FIG. 3), the gate member 270 (FIG. 4) is pivoted in a clockwise direction about the support 288. This moves the gate member 270 to enable an arcuate side surface 292 on the gate member to direct sheet material assemblages along an arcuate path toward the reject tray 42.

Although only the gate member 270 has been shown in FIG. 4, it should be understood that the gate members 272, 274 and 276 (FIG. 3) have the same construction and mode of operation as the gate member 270. It should also be understood that the actuator motor 284 has the same construction as the actuator motor 282 and is operated simultaneously with the actuator motor 282 to pivot the gate members 270–276 together.

Since the gate members 270–276 (FIG. 3) are moved by the actuator motors 282 and 284 and the cams 150 and 180 are rotated bythe nip adjustment motors 138 and 144, the gate members can be actuated without changing the size or configuration of the nip 122. This allows a relatively thick sheet material assemblage 10 having a substantial number of pages 14 and a substantial number of inserts 24 to be directed to the reject tray 42 by operating the actuator motors 282 and 284 while the size of the nip 122 remains constant. Therefore, the nip 122 can accommodate a relatively thick sheet material assemblage having a substantial number of inserts. The gate members 270 can be used to direct the sheet material assemblage 10 toward either the feed rollers 130 and 132 or the reject tray 42 while the nip 122 has a taper and width corresponding to the taper and width of the sheet material assemblage.

When a detector unit 64 (FIG. 2) detects a misfeed, or a long/skew signature group detector 68 detects signature misorientation, or the head/or foot end portion calipers 70 and 72 detect an incorrect thickness, the control assembly 66 effects operation of the gate assembly 128 to direct the imperfect sheet material assemblage 10 to the reject tray 42. The control assembly 66 effects operation of the actuator motors 282 and 284 immediately before the defective sheet material assemblage 10 enters the nip 122. Therefore, only the defective sheet material assemblage 10 is directed to the reject tray 42 by the gate assembly 128.

The reject tray 42 is movable with the second set 86 of rollers during adjustment of the nip 122. This results in the position of the reject tray 42 being the same relative to the second set 86 of rollers regardless of the size and/or configuration of the nip 122.

The reject tray 42 is connected with the support arm 104 by a support member which has been indicated schematically at 296 in FIG. 4. A similar support member connects the reject tray 42 with the support arm 116 (FIG. 3) in the right support structure 98. Therefore, upon movement of the cam 150 and/or the cam 180 to change the nip 122, the reject tray 42 moves with the second set 86 of rollers so that the position of the reject tray relative to the first set of rollers remains constant. This results in the reject tray 42 always being in the same position relative to the second set 86 of rollers when the gate assembly 128 is operated to direct a sheet material assemblage to the reject tray 42.

Operation

When the sheet material handling apparatus 30 (FIG. 2) is to be operated to assemble and handle sheet material assemblages 10 having different numbers of pages 14 and different numbers of inserts 24, the cams 150 and 180 (FIG. 3) are first adjusted. The cams 150 and 180 are adjusted to set the nip 122 to have an initial width and configuration corresponding to a central portion of a range in which the number of pages 14 and the number of inserts 24 will vary during the formation of the sheet material assemblages 10. For example, if three different types of sheet material assemblages were to be formed, the cams 150 and 180 would be adjusted so that the nip 122 has a size and configuration corresponding to the size and configuration of the average sheet material assemblage.

In one specific instance, the sheet material handling apparatus 30 is to be operated to form sheet material assemblages 10 having: (i) a first number of pages and no inserts, (ii) sheet material assemblages having the first number of pages and some inserts 24, and (iii) sheet material assemblages having a second number of pages and inserts which is greater than the first number of pages and inserts. The cams 150 and 180 are initially set so that the nip 122 has a configuration corresponding to the sheet material assemblage (ii) having the first number of pages 14 and some inserts 24.

The size of the nip 122 is initially be set by disconnecting the arm 174 (FIG. 4) from the shaft 156 to which the cam 150 is connected. The cam 150 would then be rotated to provide the left portion 194 of the nip 122 with a relatively small width, as shown in FIG. 5. The releasable connection 176 would then be engaged to fixedly connect the arm 174 with the shaft 156. At this time, the nip adjustment motor 138 would be in the central position illustrated in FIGS. 4 and 6. The cam 180 would be adjusted in a similar manner so that the right portion 196 of the nip 122 is wider than the left portion 194 of the nip when the nip adjustment motor 144 is in the central position.

When the cams 150 and 180 have been adjusted to their initial positions, the nip 122 would have a size and configuration to accommodate the sheet material assemblage (ii) having the first number of pages 14 and some inserts 24. The relatively thin head end portion 20 of the sheet material assemblage 10 would move through the relatively narrow left portion 194 of the nip 122. The relatively thick foot end portion 22 of the sheet material assemblage 10 would move through the relatively wide right portion 196 of the nip 122.

Immediately before the sheet material assemblage (i) having the first number of pages 14 and no inserts 24 is to be conducted through the nip 122, the nip adjustment motor 144 is operated to rotate the cam 180 (FIG. 3) in a counterclockwise direction. This results in a decrease in the width of the right portion 196 of the nip 122 to have the same width as the left portion 194 of the nip. Therefore, the nip 122 has a uniform width corresponding to the uniform thickness of the sheet material assemblage 10.

Immediately before the relatively thick sheet material assemblage (iii) having the second number of pages 14 and inserts 24 which is greater than the first number of pages and inserts is to be conducted through the delivery assembly 38, the nip adjustment motors 138 and 144 are both actuated to increase the width of both the left portion 194 and the right portion 196 of the nip. The relatively thick sheet material assemblage 10 containing the large number of pages 14 and inserts 24 is then conducted through the nip 122 with the head end portion 20 of the sheet material assemblage moving through the left portion 194 of the nip and the foot portion 22 with the inserts 24 moving through the right portion 196 of the nip.

Sheet material assemblages 10 containing different numbers of inserts and different numbers of pages will be sequentially formed by the sheet material handling apparatus 30. Therefore, during operation of the sheet material handling apparatus 30 (FIG. 2), the control assembly 66 will effect operation of the solenoids 242, 244 and 246 and motor control valves 234, 236 and 238 (FIG. 6) to operate the nip adjustment motor 138 to vary the size of the left portion 194 of the nip 122 to accommodate each of the different sheet material assemblages in turn. The control assembly 66 will also effect operation of solenoids and motor control valves for the nip adjustment motor 144 to effect operation of the nip adjustment motor to adjust the size of the right portion 196 of the nip 122. The control assembly 66 effects operation of the nip adjustment motors 138 and 144 so that the end portions 194 and 196 of the nip 122 are of a size corresponding to measurements made by the head and foot end portion calipers 70 and 72 as each sheet material assemblage 10 moves in turn into the nip 122.

It is contemplated that defective sheet material assemblages 10 may occasionally be formed by the sheet material handling apparatus 30. The defective sheet material assemblages 10 could be the result of a failure to feed a page 14 or to feed an insert 24. When a caliper 70 or 72 (FIG. 2) detects that either the head end portion 20 or the foot end portion 22 of a sheet material assemblage 10 has a thickness which is less than a desired thickness corresponding to the correct number of pages and/or inserts, the control assembly 66 effects operation of the actuator motors 282 and 284.

Operation of the actuator motors 282 and 284 moves the gate members 270–276 in a clockwise direction (as viewed in FIG. 4) to direct sheet material assemblages to the reject tray 42. During movement of the gate members 270–276, the size of the nip 122 remains constant. Therefore, the nip 122 will have a size corresponding to the size of a sheet material assemblage 10 being directed to the reject tray 42. Thus, when a sheet material assemblage 10 containing a relatively large number of pages 14 and inserts 24 is to be fed to the reject tray 42, the nip 122 will have a size and configuration corresponding to this sheet material assemblage. Since the reject tray 42 is connected with the second set 86 of rollers, the reject tray is always in the same position relative to the first set of rollers regardless of the size and configuration of the nip 122.

Detailed Construction

Figure 7:
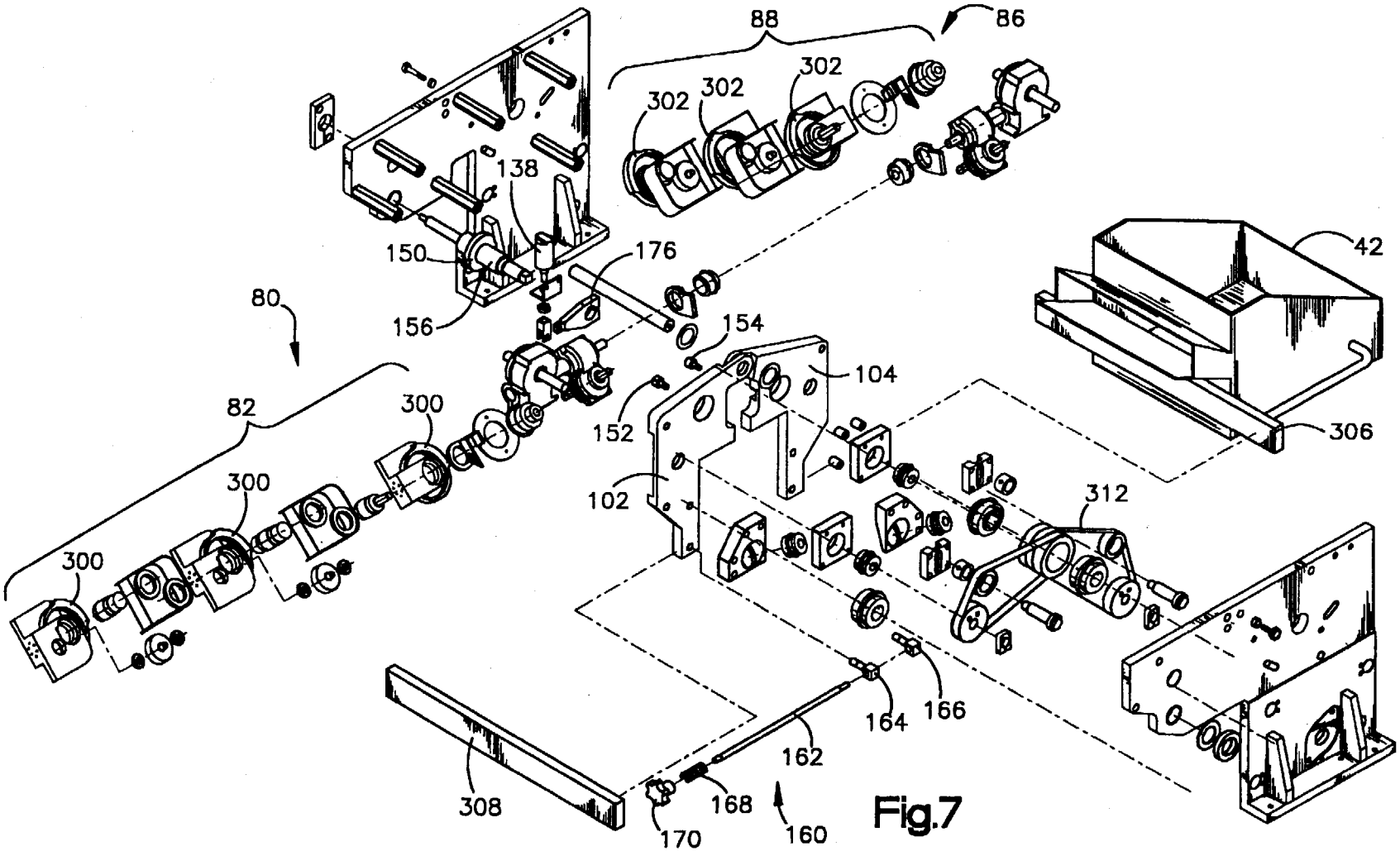
FIG. 7 is an exploded illustration of a left portion of the delivery assembly of FIG. 3.
Figure 8:
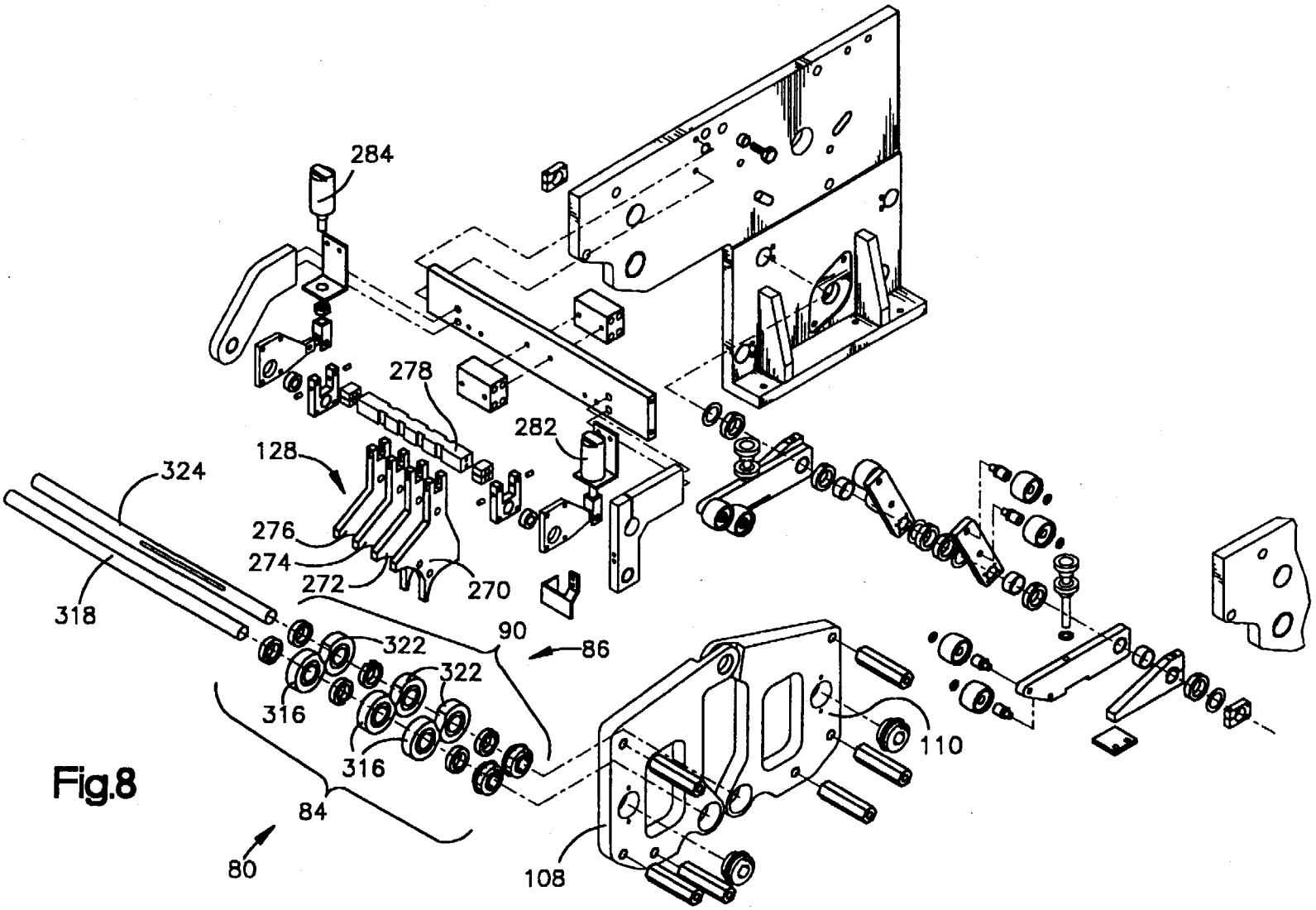
FIG. 8 is an exploded illustration of a central portion of the delivery assembly of FIG. 3.
Figure 9:
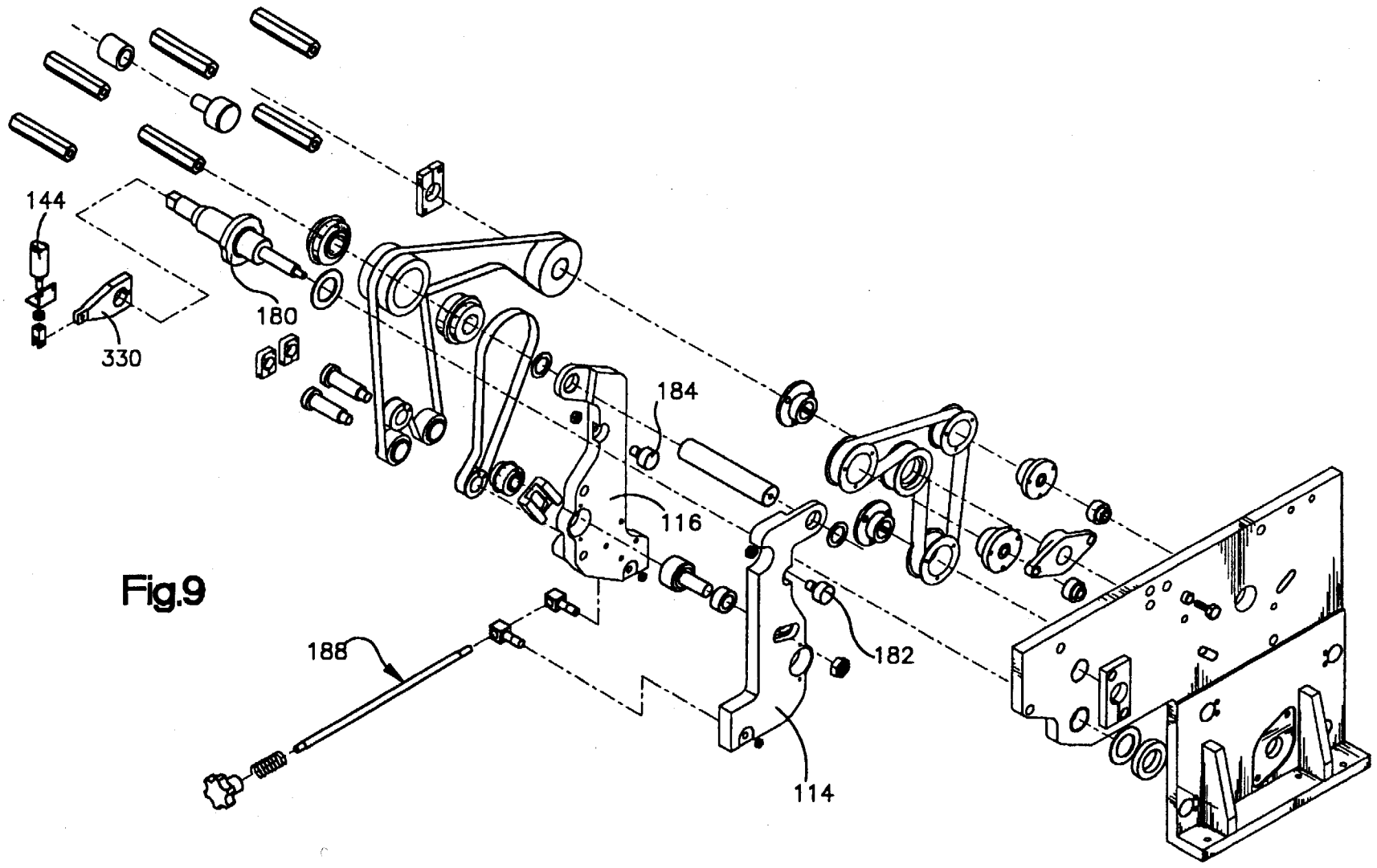
FIG. 9 is an exploded illustration of a right portion of the delivery assembly of FIG. 3.

The construction of the delivery assembly 38 has been illustrated schematically in FIGS. 3–6. A more detailed construction of the delivery assembly 38 is set forth in FIGS. 7–9. FIGS. 7–9 are exploded views of portions of the delivery assembly 38.

Referring to FIG. 7, the roller 82 in the first set 80 of rollers is formed by a plurality of roller segments 300. Each of the roller segments 300 is rotatable about an axis which is skewed at an acute angle to the longitudinal central axis of the nip 122. The roller 88 is formed of roller segments 302 which are also rotatable about axes which are skewed relative to the nip. The roller segments 300 are connected with a mounting bar 306. The roller segments 302 are connected with a mounting bar 308.

The mounting bars 306 and 308 and the rollers 82 and 88 are connected with support arms 102 and 104 (FIG. 7). A belt drive system 312 is connected with the support arms 102 and 104 and the rollers 82 and 88. Cam followers 152 and 154 are connected with the support arms 102 and 104 and are engaged by the cam 150. A releasable connection 176 is provided between the nip adjustment motor 138 and the shaft 156.

The central support arms 108 and 110 (FIG. 8) are connected with the mounting bars 306 and 308 (FIG. 7). The roller 84 in the first set 80 of rollers is formed by a plurality of roller segments 316. The roller segments 316 are fixedly connected with a shaft 318 which is rotatably supported by the support arm 114 (FIG. 9) and a support arm 108 (FIG. 8). The roller 90 (FIG. 8) in the second set 86 of rollers includes a plurality of roller segments 322 which are fixedly mounted on a shaft 324. The shaft 324 is rotatably supported by the support arm 116 (FIG. 9) and by the support arm 110 (FIG. 8).

The cam follower 182 (FIG. 9) is connected with the support arm 114 and the cam follower 184 is connected with the support arm 116. The cam 180 is disposed between the cam followers 182 and 184. A releasable connection 330 connects the nip adjustment motor 144 with a support shaft for the cam 180.

The gate assembly 128 (FIG. 8) includes gate members 270, 272, 274, and 276 which are secured to a mounting bar 278. Actuator motors 282 and 284 are connected with the mounting bar 278. The reject tray 42 is connected with the mounting bar 306 (FIG. 7) on which the roller segments 302 are mounted.

Conclusion

The present invention provides a new and improved delivery assembly 38 for feeding sheet material assemblages 10. The delivery assembly 38 includes rollers 82, 84, 88 and 90 which define the nip 122 through which the sheet material assemblages 10 are fed. Nip adjustment mechanisms 124 and 126 are provided to adjust the width of the nip 122. The nip 122 may have either a uniform or a nonuniform width. When the nip 122 has a nonuniform width, a relatively thick end portion 22 of a sheet material assemblage 10 is fed through a relatively wide portion 196 of the nip.

A gate assembly 128 is operable from a first condition to a second condition to change the direction in which sheet material assemblages are directed away from the nip 122. The gate assembly 128 can be actuated between the first and second conditions without changing the size of the nip 122. Similarly, the size of the nip 122 can be varied without changing the setting of the gate assembly 128.

Having described the invention, the following is claimed:

1. A method comprising the steps of sequentially moving sheet material assemblages having first and second end portions along a path, sensing the thickness of the first and second end portions of each of the sheet material assemblages in turn, adjusting a nip to accommodate variations in the thicknesses of the sheet material assemblages, and sequentially moving each of the sheet material assemblages through the nip, said step of sensing the thickness of the first and second end portions of the sheet material assemblages includes sensing that a first sheet material assemblage has a first end portion which is thicker than a second end portion of the first sheet material assemblage, said step of adjusting a nip includes adjusting the nip to have a first portion with a first width and a second portion with a width which is less than the first width, said step of sequentially moving sheet material assemblages through the nip includes moving the first end portion of the first sheet material assemblage into the first portion of the nip while the first portion of the nip has the first width and moving the second end portion of the first sheet material assemblage into the second portion of the nip while the second portion of the nip has a width which is less than the first width, said step of sensing the thickness of the first and second end portions of each of the sheet material assemblages in turn includes sensing that a second sheet material assemblage has a first end portion which is thicker than a second end portion of the second sheet material assemblage and sensing that the first end portion of the second sheet material assemblage has a thickness which is greater than the thickness of the first end portion of the first sheet material assemblage, said step of adjusting a nip includes adjusting the nip so that the first portion of the nip has a second width which is greater than the first width and is greater than the width of the second portion of the nip, said step of sequentially moving sheet material assemblages through the nip includes moving the first end portion of the second sheet material assemblage into the first portion of the nip while the first portion of the nip has the second width and moving the second end portion of the second sheet material assemblage into the second portion of the nip while the second portion of the nip has a width which is less than the second width.

2. A method as set forth in claim 1 wherein said step of sensing the thickness of the first and second end portions of each of the sheet material assemblages in turn includes sensing that a third sheet material assemblage has a first end portion which has the same thickness as a second end portion of the second sheet material assemblage, said step of adjusting the nip includes adjusting the nip to have first and second portions with the same width, said step of sequentially moving sheet material assemblages through the nip includes moving the first end portion of the third sheet material assemblage into the first portion of the nip and moving the second end portion of the third sheet material assemblage into the second portion of the nip while the first and second portions of the nip have the same width.

3. A method as set forth in claim 2 wherein said steps of moving the first end portion of the third sheet material assemblage into the first portion of the nip and moving the second end portion of the third sheet material assemblage into the second portion of the nip are performed prior to performance of said steps of moving the first end portion of the second sheet material assemblage into the first portion of the nip and moving the second end portion of the second sheet material assemblage into the second portion of the nip.

4. A method as set forth in claim 1 wherein said step of sensing the thickness of the first and second end portions of the sheet material assemblages includes sensing that the second end portion of the second sheet material assemblage has a thickness which is greater than the thickness of the second end portion of the first sheet material assemblage, said step of adjusting the nip so that the first portion of the nip has a second width which is greater than the first width and is greater than the width of the second portion of the nip includes adjusting the nip so that the second portion of the nip has a width which is greater than the width of the second portion of the nip upon completion of said step of adjusting the width of the nip to have a first portion with a first width and a second portion with a second width which is less than the first width.

5. A method as set forth in claim 1 wherein said method further includes sensing when a sheet material assemblage is defective and operating a gate to direct the defective sheet material assemblage exiting from the nip to a reject receiving location while maintaining the size of the nip constant.

6. An apparatus for use in feeding sheet material assemblages having different thicknesses, said apparatus comprising sensor means for sensing thickness of each of the sheet material assemblages in turn, a plurality of rollers which define a nip through which each of the sheet material assemblages moves in turn, the nip defined by said rollers has a first portion which is relatively wide and a second portion which is relatively narrow, adjustment means connected with said plurality of rollers and said sensor means for varying the size of the nip as a function of the sensed thickness of the sheet material assemblages, and gate means operable between a first condition directing sheet material assemblages which move through the nip in a first direction and a second condition directing sheet material assemblages which move through the nip in a second direction, said adjustment means being operable to vary the size of the nip in response to said sensor means sensing sheet material assemblages of different thicknesses while said gate means remains in the first condition directing the sheet material assemblages of different thicknesses in the first direction, said adjustment means including a first adjustment mechanism which is connected with at least some of said rollers of said plurality of rollers and is operable to vary the size of said first portion of said nip and a second adjustment mechanism connected with at least some of said rollers of said plurality of rollers and operable to vary the size of said second portion of said nip.

7. An apparatus as set forth in claim 6 further including actuator means for operating said gate means between the first and second conditions while the size of the nip remains constant.

8. An apparatus as set forth in claim 6 further including a sheet material assemblage holder connected with at least one of said rollers and movable with said at least one roller relative to another roller of said plurality of rollers upon operation of said adjustment means to vary the size of the nip.

9. An apparatus for use in feeding sheet material assemblages having different thicknesses, said apparatus comprising sensor means for sensing thickness of each of the sheet material assemblages in turn, a plurality of rollers which define a nip through which each of the sheet material assemblages moves in turn, the nip defined by said rollers has a first portion which is relatively wide and a second portion which is relatively narrow, adjustment means connected with said plurality of rollers for varying the size of the nip as a function of the sensed thickness of the sheet material assemblages, gate means operable between a first condition directing sheet material assemblages which move through the nip in a first direction and a second condition directing sheet material assemblages which move through the nip in a second direction, and actuator means for operating said gate means between the first and second conditions while maintaining the size of the nip constant, said adjustment means including a first adjustment mechanism which is connected with at least some of the rollers of said plurality of rollers and is operable to vary the size of said first portion of said nip and a second adjustment mechanism which is connected with at least some of said rollers of said plurality of rollers and is operable to vary the size of said second portion of said nip.

10. An apparatus as set forth in claim 9 further including control means for effecting operation of said first adjustment mechanism while said second adjustment mechanism remains inactive and for effecting operation of said second adjustment mechanism while said first adjustment mechanism remains inactive.

11. A method comprising the steps of sequentially moving sheet material assemblages having first and second end portions along a path, sensing the thickness of the first and second end portions of each of the sheet material assemblages in turn while, sheet material assemblages are moving along the path, adjusting a nip while sheet material assemblages are moving along the path to accommodate variations in the thicknesses of the sheet material assemblages, and sequentially moving each of the sheet material assemblages through the nip, said step of sensing the thickness of the first and second end portions of the sheet material assemblages includes sensing that a first sheet material assemblage has a first end portion which is thicker than a second end portion of the first sheet material assemblage while sheet material assemblages are moving along the path, said step of adjusting a nip includes operating at least one nip adjustment motor to adjust the nip to have a first portion with a first width and a second portion with a width which is less than the first width while sheet material assemblages are moving along the path, said step of sequentially moving sheet material assemblages through the nip includes moving the first end portion of the first sheet material assemblage into the first portion of the nip while the first portion of the nip has the first width and moving the second end portion of the first sheet material assemblage into the second portion of the nip while the second portion of the nip has a width which is less than the first width, said step of sensing the thickness of the first and second end portions of each of the sheet material assemblages in turn includes sensing that a second sheet material assemblage has a first end portion which is thicker than a second end portion of the second sheet material assemblage and sensing that the first end portion of the second sheet material assemblage has a thickness which is greater than the thickness of the first end portion of the first sheet material assemblage while sheet material assemblages are moving along the path, said step of adjusting a nip includes operating at least one nip adjustment motor to adjust the nip so that the first portion of the nip has a second width which is greater than the first width and is greater than the width of the second portion of the nip while sheet material assemblages are moving along the path, said step of sequentially moving sheet material assemblages through the nip includes moving the first and portion of the second sheet material assemblage into the first portion of the nip while the first portion of the nip has the second width and moving the second end portion of the second sheet material assemblage into the second portion of the nip while the second portion of the nip has a width which is less than the second width.

12. A method as set forth in claim 11 wherein said step of sensing the thickness of the first and second end portions of each of the sheet material assemblages in turn includes sensing that a third sheet material assemblage has a first end portion which has the same thickness as a second end portion of the second sheet material assemblage while sheet material assemblages are moving along the path, said step of adjusting the nip includes operating at least one nip adjustment motor to adjust the nip to have first and second portions with the same width while sheet material assemblages are moving along the path, said step of sequentially moving sheet material assemblages through the nip includes moving the first end portion of the third sheet material assemblage into the first portion of the nip and moving the second end portion of the third sheet material assemblage into the second portion of the nip while the first and second portions of the nip have the same width.

13. A method as set forth in claim 12 wherein said steps of moving the first end portion of the third sheet material assemblage into the first portion of the nip and moving the second end portion of the third sheet material assemblage into the second portion of the nip are performed prior to performance of said steps of moving the first end portion of the second sheet material assemblage into the first portion of the nip and moving the second end portion of the second sheet material assemblage into the second portion of the nip.

14. A method as set forth in claim 11 wherein said step of sensing the thickness of the first and second end portions of the sheet material assemblages includes sensing that the second end portion of the second sheet material assemblage has a thickness which is greater than the thickness of the second end portion of the first sheet material assemblage while sheet material assemblages are moving along the path, said step of adjusting the nip so that the first portion of the nip has a second width which is greater than the first width and is greater than the width of the second portion of the nip while sheet material assemblages are moving along the path includes operating at least one nip adjustment motor to adjust the nip so that the second portion of the nip has a width which is greater than the width of the second portion of the nip upon completion of said step of adjusting the width of the nip to have a first portion with a first width and a second portion with a second width which is less than the first width.

15. A method as set forth in claim 11 wherein said method further includes sensing when a sheet material assemblage is defective and operating a gate actuation motor to move a gate to direct the defective sheet material assemblage exiting from the nip to a reject receiving location while maintaining the size of the, nip constant, said step of operating the gate actuation motor being performed while sheet material assemblages are moving along the path.

16. A method comprising the steps of sequentially forming sheet material assemblages having thick and thin end portions, said step of sequentially forming sheet material assemblages includes forming sheet material assemblages of different thicknesses, moving the sheet material assemblages along a path, sensing the thickness of each of the sheet material assemblages in turn as they move along the path, operating at least one nip adjustment motor to adjust the size of a nip to have a first portion which is relatively wide and second portion which is relatively narrow during movement of the sheet material assemblages along the path, sequentially moving sheet material assemblages through the nip, said step of sequentially moving sheet material assemblages through the nip includes moving a thick end portion of one sheet material assemblage through the first portion of the nip, moving a thin end portion of the one sheet material assemblage through the second portion of the nip, and simultaneously therewith moving a portion of the one sheet material assemblage disposed between the thick and thin end portions of the one sheet material assemblage through a portion of the nip disposed between the first and second portions of the nip, operating a gate actuation motor to move a gate from a first condition to a second condition to direct an improperly formed sheet material assemblage exiting from the nip in a first direction away from the nip during movement of the sheet material assemblages along the path, and operating the gate actuation motor to move the gate from the second condition to the first condition to direct a properly formed sheet material assemblages exiting from the nip in a second direction away from the nip during movement of the sheet material assemblages along the path.

17. An apparatus for use in feeding sheet material assemblages having different thicknesses, said apparatus comprising a plurality of rollers which define a nip through which each of the sheet material assemblages move in turn, adjustment means connected with said plurality of rollers for varying the size of the nip, gate means operable between a first condition directing sheet material assemblages which move through the nip in a first direction and a second condition directing sheet material assemblages which move through the nip in a second direction, and a sheet material assemblage holder connected with a first roller of said plurality of rollers and movable with said first roller of said plurality of rollers relative to a second roller of said plurality of rollers upon operation of said adjustment means to vary the size of at least a portion of the nip, said gate means being operable to direct sheet material assemblages into said sheet material assemblage holder when said gate means is in the first condition.

18. An apparatus as set forth in claim 17 further including actuator means for operating said gate means between the first and second conditions while the size of the nip remains constant.

19. An apparatus as set forth in claim 17 wherein the nip defined by said plurality of rollers has a first portion which is relatively wide and a second portion which is relatively narrow, said adjustment means including a first adjustment mechanism which is connected with at least some of said rollers of said plurality of rollers and is operable to vary the size of said first portion of said nip and a second adjustment mechanism connected with at least some of said rollers of said plurality of rollers and operable to vary the size of said second portion of said nip.

20. An apparatus as set forth in claim 19 further including sensor means for sensing thickness of each of the sheet material assemblages in turn, said first and second adjustment mechanisms being connected with said sensor means and being operable to vary the size of the nip as a function of the sensed thickness of the sheet material assemblages.

21. An apparatus as set forth in claim 20 further including control means connected with said sensor means and said first and second adjustment mechanisms for effecting operation of said first adjustment mechanism while said second adjustment mechanism remains inactive and for effecting operation of said second adjustment mechanism while said first adjustment mechanism remains inactive.

22. An apparatus for use in feeding sheet material assemblages each of which has a folded edge portion which extends between thick and thin end portions of the sheet material assemblage, said apparatus comprising a plurality of rollers which define a nip having a width which varies along the length of the nip and through which the sheet material assemblages sequentially move with their folded edge portions leading, said plurality of rollers having first end portions which define a wide end portion of the nip and second end portions which define a narrow end portion of the nip, sensor means for sequentially sensing variations in the thickness of the thick end portions of the sheet material assemblages and for sequentially sensing variations in the thickness of the thin end portions of the sheet material assemblages, a first adjustment motor connected with said sensor means and said first end portions of said plurality of rollers and operable to vary the width of the wide end portion of the nip in response to said sensor means detecting a variation in the thickness of the thick portions of the sheet material assemblages, and a second adjustment motor connected with said sensor means and said second end portions of said plurality of rollers and operable to vary the width of the narrow end portion of the nip in response to said sensor means detecting a variation in the thickness of the thin portions of the sheet material assemblages.

23. An apparatus as set forth in claim 22 further including gate means operable between a first condition directing sheet material assemblages which move through the nip in a first direction and a second condition directing sheet material assemblages which move through the nip in a second direction, and a sheet material assemblage holder connected with at least one of the rollers of the plurality of rollers and movable with said one roller relative to another roller of the plurality of rollers upon operation of one of said first and second adjustment motors to vary the width of at least a portion of the nip, said gate means being operable to direct sheet material assemblages into said sheet material assemblage holder when said gate means is in the first condition.

24. A method comprising the steps of sequentially forming sheet material assemblages having first and second end portions, sensing the thickness of each of the sheet material assemblages in turn, detecting improper formation of a sheet material assemblage, adjusting the size of a nip to accommodate variations in the thickness of the sheet material assemblages, sequentially moving sheet material assemblages through the nip, operating a gate from a first condition to a second condition to direct an improperly formed sheet material assemblage exiting from the nip in a first direction away from the nip, operating the gate from the second condition to the first condition enabling sheet material assemblages to exit from the nip and move in a second direction away from the nip, and maintaining the size of the nip constant during operation of the gate between the first and second conditions, said step of sensing the thickness of each of the sheet material assemblages in turn includes sensing that a first sheet material assemblage has a first end portion which is thicker than a second end portion of the first sheet material assemblage, said step of adjusting the size of a nip includes adjusting the nip to have a first portion with a first width and a second portion with a width which is less than the first width, said step of sequentially moving sheet material assemblages through the nip includes moving the first end portion of the first sheet material assemblage into the first portion of the nip while the first portion of the nip has the first width and moving the second end portion of the first sheet material assemblage into the second portion of the nip while the second portion of the nip has a width which is less than the first width, said step of sensing the thickness of each of the sheet material assemblages in turn includes sensing that a second sheet material assemblage has a first end portion which has the same thickness as a second end portion of the second sheet material assemblage, said step of adjusting the nip includes adjusting the nip to have first and second portions with the same width, said step of sequentially moving sheet material assemblages through the nip includes moving the first end portion of the second sheet material assemblage into the first portion of the nip and moving the second end portion of the second sheet material assemblage into the second portion of the nip while the first and second portions of the nip have the same width.

25. A method comprising the steps of providing a nip which is formed between a plurality of rollers and which has a first portion which is relatively wide and a second portion which is relatively narrow, moving a sheet material assemblage having a thick end portion and a thin end portion which are interconnected by a folded edge portion along a path which leads to the nip, sensing the thickness of the thick end portion of the sheet material assemblage while the sheet material assemblage is moving along the path, effecting operation of a first nip adjustment mechanism to vary the size of the first portion of the nip while the sheet material assemblage is moving along the path, said step of effecting operation of the first nip adjustment mechanism being taken in response to a sensing that the thick end portion of the sheet material assemblage has a thickness which requires a change in the width of the first portion of the nip to facilitate movement of the thick end portion of the sheet material assemblage through the first portion of the nip, thereafter, moving the sheet material assemblage through the nip, said step of moving the sheet material assemblage through the nip includes moving the thick end portion of the sheet material assemblage through the first portion of the nip which is relatively wide and moving the thin end portion of the sheet material assemblage through the second portion of the nip which is relatively narrow.

26. A method as set forth in claim 25 further including the steps of sensing the thickness of the thin end portion of the sheet material assemblage while the sheet material assemblage is moving along the path, and effecting operation of a second nip adjusting mechanism to vary the size of the second portion of the nip while the sheet material assemblage is moving along the path, said step of effecting operation of the second nip adjustment mechanism being taken in response to a sensing that the thin end portion of the sheet material assemblage has a thickness which requires a change in the width of the second portion of the nip to facilitate movement of the thin end portion of the sheet material assemblage through the second portion of the nip.

27. A method comprising the steps of rotating a first roller about a first axis, rotating a second roller about a second axis which is skewed at an acute angle to the first axis to form a nip between the first and second rollers having a first portion which is relatively wide and a second portion which is relatively narrow, moving a sheet material assemblage having a thick end portion and a thin end portion which are interconnected by a folded edge portion along a path which leads to the nip, sensing the thickness of the thick end portion of the sheet material assemblage while the sheet material assemblage is moving along the path, varying the size of the first portion of the nip while the sheet material assemblage is moving along the path and in response to a sensing that the thick end portion of the sheet material assemblage has a thickness which requires a change in the width of the first portion of nip to facilitate moving the thick end portion of the sheet material assemblage through the first portion of the nip, and moving a sheet material assemblage having a thick end portion and a thin end portion which are interconnected by a folded edge portion through the nip, said step of moving the sheet material assemblage through the nip includes moving the thick end portion of the sheet material assemblage through the first portion of the nip and moving the thin end portion of the sheet material assemblage through the second portion of the nip while the first and second rollers are rotating about the first and second axes, said step of moving the sheet material assemblage through the nip being performed with the folded edge portion leading and with the folded edge portion extending between the first and second portions of the nip.

28. A method as set forth in claim 27 further including the steps of operating a first adjustment mechanism to vary the size of the first portion of the nip and operating a second adjustment mechanism to vary the size of the second portion of the nip.

29. A method as set forth in claim 28 wherein said step of operating a first adjustment mechanism is performed while the second adjustment mechanism is in an inactive condition in which the second adjustment mechanism is ineffective to vary the size of the second portion of the nip, said step of operating a second adjustment mechanism being performed while the first adjustment mechanism is in an inactive condition in which the first adjustment mechanism is ineffective to vary the size of the first portion of the nip.

30. A method as set forth in claim 27 further including the steps of sensing when a sheet material assemblage is defective and operating a gate to direct the defective sheet material assemblage exiting from the nip to a reject receiving location while maintaining the size of the nip constant.

31. A method as set forth in claim 27 further including the steps of sensing the thickness of the thin end portion of the sheet material assemblage while the sheet material assemblage is moving along the path and varying the size of the second portion of the nip in response to a sensing that the thin end portion of the sheet material assemblage has a thickness which requires a change in the width of the second portion of the nip to facilitate moving the thin end portion of the sheet material assemblage through the second portion of the nip.

* * * * *